US009177755B2

(12) United States Patent
Parker et al.

(10) Patent No.: US 9,177,755 B2
(45) Date of Patent: Nov. 3, 2015

(54) MULTI-TARGET X-RAY TUBE WITH STATIONARY ELECTRON BEAM POSITION

(71) Applicant: Moxtek, Inc., Orem, UT (US)

(72) Inventors: Todd S. Parker, Kaysville, UT (US); Steven D. Liddiard, Springville, UT (US); Dave Reynolds, Orem, UT (US)

(73) Assignee: Moxtek, Inc., Orem, UT (US)

( * ) Notice: Subject to any disclaimer, the term of this patent is extended or adjusted under 35 U.S.C. 154(b) by 189 days.

(21) Appl. No.: 14/163,486

(22) Filed: Jan. 24, 2014

(65) Prior Publication Data

US 2014/0314209 A1 Oct. 23, 2014

Related U.S. Application Data

(60) Provisional application No. 61/772,411, filed on Mar. 4, 2013, provisional application No. 61/814,036, filed on Apr. 19, 2013.

(51) Int. Cl.

| | |
|---|---|
| ***H01J 35/24*** | (2006.01) |
| ***H01J 35/10*** | (2006.01) |
| ***H01J 35/14*** | (2006.01) |
| ***H01J 35/28*** | (2006.01) |

(52) U.S. Cl.

CPC ..... *H01J 35/24* (2013.01); *H01J 35/10* (2013.01); *H01J 35/14* (2013.01); *H01J 35/28* (2013.01); *H01J 2235/086* (2013.01); *H01J 2235/087* (2013.01); *H01J 2235/186* (2013.01)

(58) Field of Classification Search

CPC ..... H01J 35/18; H01J 2235/186; H01J 2235/081; H01J 2235/08; H01J 2235/18; H01J 35/24; H01J 35/28; H01J 35/14; H01J 35/10; H01J 2235/086

See application file for complete search history.

(56) References Cited

U.S. PATENT DOCUMENTS

| | | | |
|---|---|---|---|
| 1,946,288 | A | 2/1934 | Kearsley |
| 2,298,335 | A | 9/1940 | Atlee |
| 2,291,948 | A | 8/1942 | Cassen |
| 2,316,214 | A | 4/1943 | Atlee et al. |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

U.S. Appl. No. 13/812,102, filed Jan. 24, 2013; Dongbing Wang.

(Continued)

*Primary Examiner* — Brooke Purinton

(74) *Attorney, Agent, or Firm* — Thorpe North & Western, LLP

(57) ABSTRACT

A transmission x-ray tube comprising an end window hermetically sealed to a flexible coupling. The flexible coupling can allow the window to shift or tilt in one direction or another direction to allow an electron beam to impinge upon one region of the window or another region of the window.

A method of utilizing different regions of an x-ray tube target by tilting an x-ray tube window at an acute angle with respect to an electron beam axis to cause an electron beam to impinge on a selected region of the window and tilting the window in a different direction to allow the electron beam to impinge on a different selected region of the window.

20 Claims, 6 Drawing Sheets

(56) References Cited

U.S. PATENT DOCUMENTS

| | | | | |
|---|---|---|---|---|
| 2,329,318 | A | 9/1943 | Atlee et al. | |
| 2,549,614 | A | 4/1951 | Leighton | |
| 2,683,223 | A | 7/1954 | Hosemann | |
| 2,952,790 | A | 9/1960 | Steen | |
| 3,679,927 | A | 7/1972 | Kirkendall | |
| 3,751,701 | A | 8/1973 | Gralenski et al. | |
| 3,753,020 | A | 8/1973 | Zingaro | |
| 3,794,872 | A * | 2/1974 | Haas | H01J 35/24 313/32 |
| 3,801,847 | A | 4/1974 | Dietz | |
| 3,882,339 | A | 5/1975 | Rate et al. | |
| 3,900,751 | A | 8/1975 | Holland et al. | |
| 4,007,375 | A | 2/1977 | Albert | |
| 4,075,526 | A | 2/1978 | Grubis | |
| 4,184,097 | A | 1/1980 | Auge | |
| 4,400,822 | A | 8/1983 | Kuhnke et al. | |
| 4,504,895 | A | 3/1985 | Steigerwald | |
| 4,521,902 | A | 6/1985 | Peugeot | |
| 4,573,186 | A | 2/1986 | Reinhold | |
| 4,679,219 | A | 7/1987 | Ozaki | |
| 4,688,241 | A | 8/1987 | Peugeot | |
| 4,734,924 | A | 3/1988 | Yahata et al. | |
| 4,761,804 | A | 8/1988 | Yahata | |
| 4,777,642 | A | 10/1988 | Ono | |
| 4,797,907 | A | 1/1989 | Anderton | |
| 4,870,671 | A | 9/1989 | Hershyn | |
| 4,878,866 | A | 11/1989 | Mori et al. | |
| 4,891,831 | A | 1/1990 | Tanaka et al. | |
| 4,969,173 | A | 11/1990 | Valkonet | |
| 4,979,199 | A | 12/1990 | Cueman et al. | |
| 4,995,069 | A | 2/1991 | Tanaka | |
| 5,077,771 | A | 12/1991 | Skillicorn et al. | |
| 5,077,777 | A | 12/1991 | Daly | |
| 5,105,456 | A | 4/1992 | Rand et al. | |
| 5,187,737 | A | 2/1993 | Watanabe | |
| 5,200,984 | A | 4/1993 | Laeuffer | |
| RE34,421 | E | 10/1993 | Parker et al. | |
| 5,343,112 | A | 8/1994 | Wegmann | |
| 5,347,571 | A | 9/1994 | Furbee et al. | |
| 5,400,385 | A | 3/1995 | Blake et al. | |
| 5,422,926 | A | 6/1995 | Smith | |
| 5,428,658 | A | 6/1995 | Oettinger et al. | |
| 5,469,490 | A | 11/1995 | Golden et al. | |
| RE35,383 | E | 11/1996 | Miller et al. | |
| 5,621,780 | A | 4/1997 | Smith et al. | |
| 5,627,871 | A | 5/1997 | Wang | |
| 5,631,943 | A | 5/1997 | Miles | |
| 5,680,433 | A | 10/1997 | Jensen | |
| 5,682,412 | A | 10/1997 | Skillicorn et al. | |
| 5,696,808 | A | 12/1997 | Lenz | |
| 5,729,583 | A | 3/1998 | Tang et al. | |
| 5,812,632 | A | 9/1998 | Schardt et al. | |
| 5,907,595 | A | 5/1999 | Sommerer | |
| 5,978,446 | A | 11/1999 | Resnick | |
| 6,005,918 | A | 12/1999 | Harris et al. | |
| 6,044,130 | A | 3/2000 | Inazura et al. | |
| 6,075,839 | A | 6/2000 | Treseder | |
| 6,097,790 | A | 8/2000 | Hasegawa et al. | |
| 6,134,300 | A | 10/2000 | Trebes et al. | |
| 6,205,200 | B1 | 3/2001 | Boyer et al. | |
| 6,282,263 | B1 | 8/2001 | Arndt et al. | |
| 6,351,520 | B1 | 2/2002 | Inazaru | |
| 6,385,294 | B2 | 5/2002 | Suzuki et al. | |
| 6,438,207 | B1 | 8/2002 | Chidester et al. | |
| 6,477,235 | B2 | 11/2002 | Chornenky et al. | |
| 6,487,272 | B1 | 11/2002 | Kutsuzawa | |
| 6,487,273 | B1 | 11/2002 | Takenaka et al. | |
| 6,494,618 | B1 | 12/2002 | Moulton | |
| 6,546,077 | B2 | 4/2003 | Chornenky et al. | |
| 6,560,315 | B1 | 5/2003 | Price et al. | |
| 6,567,500 | B2 | 5/2003 | Rother | |
| 6,646,366 | B2 | 11/2003 | Hell et al. | |
| 6,661,876 | B2 | 12/2003 | Turner et al. | |
| 6,778,633 | B1 | 8/2004 | Loxley et al. | |
| 6,799,075 | B1 | 9/2004 | Chornenky et al. | |
| 6,803,570 | B1 | 10/2004 | Bryson, III et al. | |
| 6,816,573 | B2 | 11/2004 | Hirano et al. | |
| 6,819,741 | B2 | 11/2004 | Chidester | |
| 6,876,724 | B2 | 4/2005 | Zhou | |
| 6,976,953 | B1 | 12/2005 | Pelc | |
| 6,987,835 | B2 | 1/2006 | Lovol | |
| 7,035,379 | B2 | 4/2006 | Turner et al. | |
| 7,046,767 | B2 | 5/2006 | Okada et al. | |
| 7,049,735 | B2 | 5/2006 | Ohkubo et al. | |
| 7,050,539 | B2 | 5/2006 | Loef et al. | |
| 7,085,354 | B2 | 8/2006 | Kanagami | |
| 7,130,380 | B2 | 10/2006 | Lovoi et al. | |
| 7,130,381 | B2 | 10/2006 | Lovoi et al. | |
| 7,203,283 | B1 | 4/2007 | Puusaari | |
| 7,206,381 | B2 | 4/2007 | Shimono et al. | |
| 7,215,741 | B2 | 5/2007 | Ukita | |
| 7,224,769 | B2 | 5/2007 | Turner | |
| 7,286,642 | B2 | 10/2007 | Ishikawa et al. | |
| 7,305,066 | B2 | 12/2007 | Ukita | |
| 7,317,784 | B2 | 1/2008 | Durst et al. | |
| 7,382,862 | B2 | 6/2008 | Bard et al. | |
| 7,428,298 | B2 | 9/2008 | Bard et al. | |
| 7,448,801 | B2 | 11/2008 | Oettinger et al. | |
| 7,448,802 | B2 | 11/2008 | Oettinger et al. | |
| 7,526,068 | B2 | 4/2009 | Dinsmore | |
| 7,529,345 | B2 | 5/2009 | Bard et al. | |
| 7,634,052 | B2 | 12/2009 | Grodzins et al. | |
| 7,649,980 | B2 | 1/2010 | Aoki et al. | |
| 7,657,002 | B2 | 2/2010 | Burke et al. | |
| 7,693,265 | B2 | 4/2010 | Hauttmann et al. | |
| 7,839,254 | B2 | 11/2010 | Dinsmore et al. | |
| 7,983,394 | B2 | 7/2011 | Kozaczek et al. | |
| 8,247,971 | B1 | 8/2012 | Bard | |
| 8,526,574 | B2 | 9/2013 | Wang et al. | |
| 2004/0076260 | A1 | 4/2004 | Charles Jr et al. | |
| 2006/0210020 | A1 | 9/2006 | Takahashi et al. | |
| 2006/0280289 | A1 | 12/2006 | Hanington et al. | |
| 2007/0217574 | A1 | 9/2007 | Beyerlein | |
| 2008/0084966 | A1 * | 4/2008 | Aoki | H01J 35/24 378/140 |
| 2010/0189225 | A1 | 7/2010 | Ernest et al. | |
| 2011/0135066 | A1 | 6/2011 | Behling | |
| 2013/0077758 | A1 | 3/2013 | Miller | |
| 2013/0121472 | A1 | 5/2013 | Wang | |
| 2013/0136237 | A1 | 5/2013 | Wang | |
| 2013/0163725 | A1 | 6/2013 | Hansen et al. | |
| 2013/0170623 | A1 | 7/2013 | Reynolds et al. | |
| 2013/0223109 | A1 | 8/2013 | Wang | |
| 2013/0308757 | A1 | 11/2013 | Wang | |

FOREIGN PATENT DOCUMENTS

| | | |
|---|---|---|
| DE | 19818057 | 11/1999 |
| GB | 1252290 | 11/1971 |
| JP | 5135722 | 6/1993 |
| JP | 08315783 | 11/1996 |
| JP | 2003/007237 | 1/2003 |

OTHER PUBLICATIONS

U.S. Appl. No. 13/217,932, filed Aug. 25, 2011; Dave Reynolds.
U.S. Appl. No. 13/307,579, filed Nov. 30, 2011; Dongbing Wang.
U.S. Appl. No. 13/307,559, filed Nov. 30, 2011; Dongbing Wang.
U.S. Appl. No. 13/625,705, filed Sep. 24, 2012; Dongbing Wang.
U.S. Appl. No. 13/863,144, filed Apr. 15, 2013, Dongbing Wang.
U.S. Appl. No. 13/863,148, filed Apr. 15, 2013; Dongbing Wang.
U.S. Appl. No. 14/038,226, filed Sep. 26, 2013, Dongbing Wang.
http://www.orau.org/ptp/collection/xraytubescollidge/MachelettCW250.htm, 1999, 2 pgs.

* cited by examiner

MULTI-TARGET X-RAY TUBE WITH STATIONARY ELECTRON BEAM POSITION

CLAIM OF PRIORITY

This claims priority to U.S. Provisional Patent Application No. 61/772,411, filed on Mar. 4, 2013, and to U.S. Provisional Patent Application No. 61/814,036, filed on Apr. 19, 2013, which are hereby incorporated herein by reference in their entirety.

FIELD OF THE INVENTION

The present application is related generally to x-ray sources.

BACKGROUND

X-ray tubes can include a target material for production of x-rays in response to impinging electrons from an electron emitter. In a transmission or end anode x-ray tube, the target material can be on an x-ray window. X-rays can be produced in the target material, then emitted out of the x-ray tube through the window. In a side window x-ray tube, x-rays produced on the target can be transmitted through an interior of the x-ray tube to and through a window (physically separate from the target).

There are various advantages to having an ability to use different regions of the target, i.e. allowing the electron beam to impinge on different regions of the target at different times. One advantage is to allow use of a new region of the target when a previously used region has worn out or become too pitted for further use. Another advantage is to allow for different x-ray energy spectra, which can be done by use of different target materials in different target regions. For example, if the target includes a silver region and a gold region, x-rays emitted when the electron beam is directed at the silver region will have a different energy spectra than x-rays emitted when the electron beam is directed at the gold region. Another advantage is to allow for different target thicknesses. A thinner target region can be used when the x-ray tube is operated at lower voltages and a thicker target region can be used when the x-ray tube is operated at higher voltages.

It can be disadvantageous if the electron beam is redirected to different regions of the target. If x-rays are emitted in one direction while using one region of the anode, then emitted in another direction while using another region of the anode, the x-ray user may need to re-collimate and/or realign the x-ray tube with each different use. This need to re-collimate or realign optics can be undesirable.

Information relevant to attempts to address these problems can be found in U.S. Pat. No. 2,298,335, U.S. Pat. No. 2,549,614, U.S. Pat. No. 3,753,020, U.S. Pat. No. 3,900,751, U.S. Pat. No. 5,655,000, U.S. Pat. No. 6,560,315, and U.S. Pat. No. 7,983,394; U.S. Patent Publication Number US 2011/0135066; and Japan Patent Number JP 3,812,165.

SUMMARY

It has been recognized that it would be advantageous to allow use of multiple regions of a target in an x-ray tube, while maintaining a stationary electron beam position (i.e. keeping the electron beam directed in a single direction). The present invention is directed to a transmission x-ray tube and a method of utilizing different regions of an x-ray tube target that satisfies these needs.

The transmission x-ray tube can comprise an end window hermetically sealed to a first end of a flexible coupling; a second end of the flexible coupling hermetically sealed to one end of an enclosure; a cathode including an electron emitter hermetically sealed to an opposite end of the enclosure; the electron emitter configured to emit electrons in an electron beam along an electron beam axis extending between the electron emitter and the window and through a hollow core of the flexible coupling. The window can include a target material configured to produce x-rays in response to impinging electrons from the electron emitter. The window can be configured to allow the x-rays to be transmitted out of the enclosure through the window. The window can be selectively tiltable to selectively align a region of the window with the electron beam axis, and thus selectively position the region in the electron beam by tilting the window and the first end of the flexible coupling at an acute angle with respect to the electron beam axis.

The method, of utilizing different regions of an x-ray tube target, can comprise tilting a transmission x-ray tube end window at an acute angle with respect to an electron beam axis extending between an electron emitter and the anode to cause an electron beam to impinge on a selected region of the window and tilting the window in a different direction to selectively align a different selected region of the window with the electron beam axis, and to cause the electron beam to impinge on the different selected region of the window.

DETAILED DESCRIPTION

Figure 1:
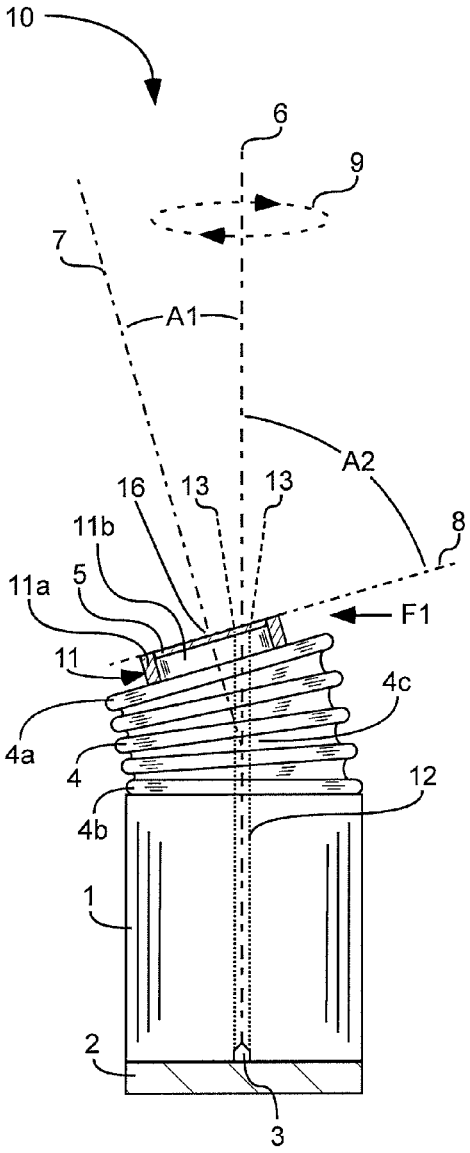
FIG. 1 is a schematic cross-sectional side view of a transmission x-ray tube including an end window tilted at an acute angle with respect to an electron beam axis, in accordance with an embodiment of the present invention.
Figure 2:
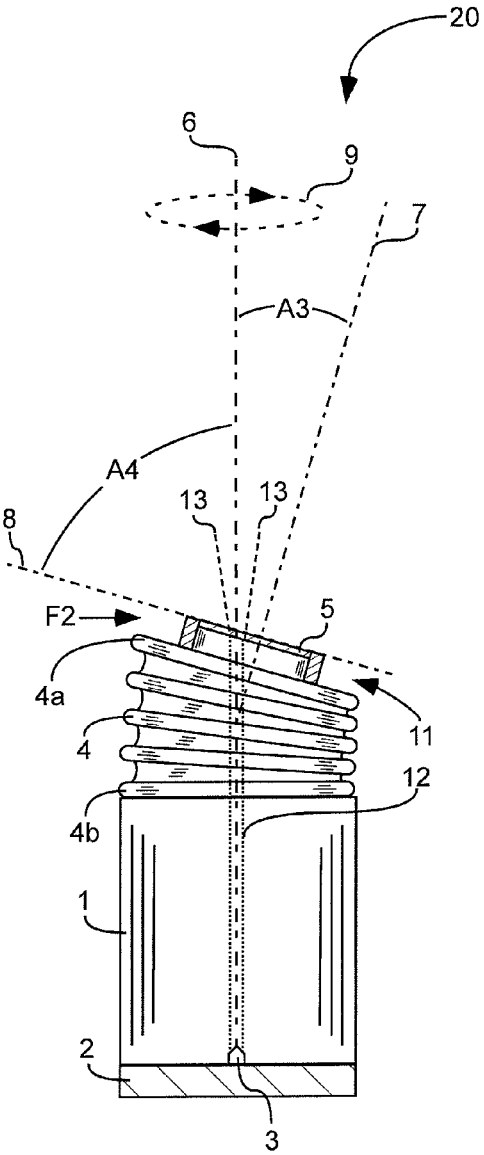
FIG. 2 is a schematic cross-sectional side view of a transmission x-ray tube including an end window tilted at an acute angle with respect to the electron beam axis, tilted in a different direction than was shown in FIG. 1, in accordance with an embodiment of the present invention.

As illustrated in FIGS. 1-2, transmission x-ray tubes 10 and 20 are shown comprising an end window 5, a flexible coupling 4, a cathode 2 including an electron emitter 3, and an enclosure 1. The flexible coupling 4 can be or can include a bellows. The end window 5 can be hermetically sealed to a first end 4*a* of the flexible coupling 4. An anode 11 can connect the window 5 to the flexible coupling 4. The anode 11 can be ring-shaped and can include an outer wall or perimeter 11*a* surrounding a hollow center 11*b* for passage of electrons to the window 5. A second end 4*b* of the flexible coupling 4 can be hermetically sealed to one end of the enclosure 1. The flexible coupling 4 can have a hollow core 4*c* for passage of electrons to the window 5.

The cathode 2 can be hermetically sealed to an opposite end of the enclosure 1. The cathode's 2 electron emitter 3 can be configured to emit electrons in an electron beam 12 along an electron beam axis 6 extending between the electron emitter 3 and the window 5 and through the enclosure 1, through a the hollow core 4*c* of the flexible coupling 4. The electron beam axis 6 can extend in a straight line between the electron emitter 3 and the window 5. Alternatively, the electron beam axis 6 can curve if there is a curvature in the overall path or trajectory of electrons from electron emitter 3 to window 5.

The window 5 can include a target material configured to produce x-rays 13 in response to impinging electrons from the electron emitter 3 and to emit x-rays 13 out of the enclosure 1 through the window 5. The window can be selectively tiltable to selectively align a region 35 (regions are shown in top views of the x-ray source in FIGS. 3-7 and 11-12) of the window 5 with the electron beam axis 6, and thus selectively position the region 35 in the electron beam 12 by tilting the window and the first end 4*a* of the flexible coupling 4 at an acute angle (A2 in FIG. 1 or A4 in FIG. 2) with respect to the electron beam axis 6. The acute angle A2 or A4 is an angle between the electron beam axis 6 and a plane 8 of a face of the window 5.

The acute angle can theoretically be any acute angle. For practical purposes, the acute angle may need to be sufficiently small to allow a large enough shift of the location where the electron beam 12 impinges on the window 5. A larger shift of location, and thus a smaller angle may be needed, if different regions are made of different materials. This larger shift may be needed in order to avoid the electron beam impinging on multiple regions, and thus multiple materials, at one time. It can be desirable to not have too small of an acute angle in order to minimize stress on the flexible coupling 4. Angle A2 or A4 can be less than 89 degrees in one embodiment, between 70 degrees and 85 degrees in another embodiment, or between 60 degrees and 89 degrees in another embodiment.

Figure 3:
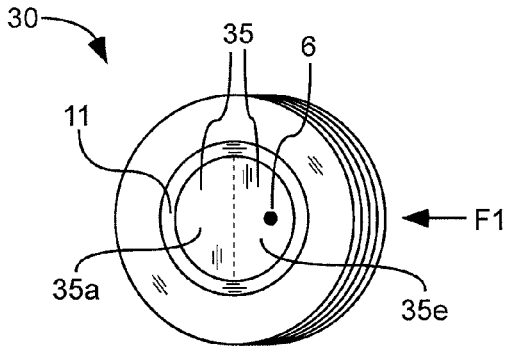
FIG. 3 is a schematic top view of a transmission x-ray tube including an end window tilted at an acute angle with respect to the electron beam axis, in accordance with an embodiment of the present invention.
Figure 4:
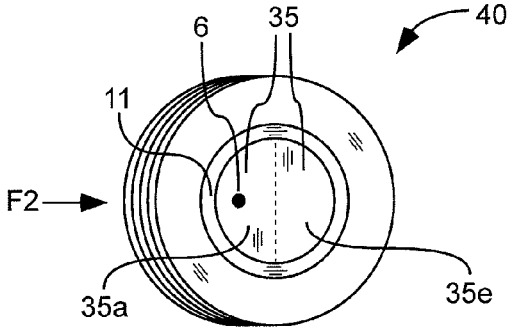
FIG. 4 is a schematic top view of a transmission x-ray tube including an end window tilted at an acute angle with respect to the electron beam axis, in a different direction than was shown in FIG. 3, in accordance with an embodiment of the present invention.

The window 5 can include at least two different regions 35*a-b*. As shown in FIGS. 1 & 3, the window 5 can be tilted in one direction (tilted left in FIGS. 1 & 3) at an acute angle A2 by a force F1. The flexible coupling 4 can allow the window to tilt at this acute angle A2. Tilting the window 5 at this acute angle can cause the electron beam axis 6 to pass through one region 35*e* of the window 5 (region 35*e* is shown as a right portion of the window 5 in the figures). As shown in FIGS. 2 & 4, the window 5 can be tilted in a different direction (tilted right in FIGS. 2 & 4) at an acute angle A4 by a force F2. The flexible coupling 4 can allow the window to tilt at this acute angle A4. Tilting the window 5 at this acute angle can cause the electron beam axis 6 to pass through a different region 35*a* of the window 5 (region 35*a* is shown as a left portion of the window 5 in the figures). Acute angle A2 can be the same as, or different from, acute angle A4 (same numerical value but different direction). Alternatively, acute angle A2 can be the different from acute angle A4 (different numerical value and different direction).

Figure 5:
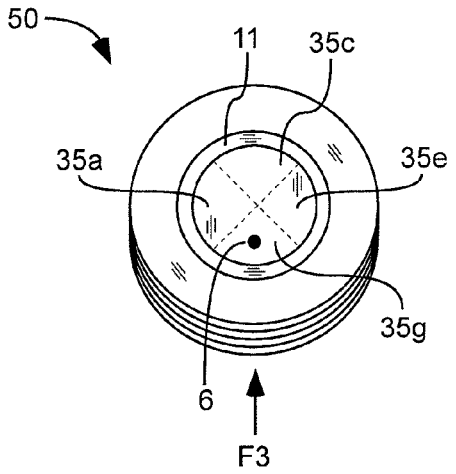
FIG. 5 is a schematic top view of a transmission x-ray tube including an end window tilted at an acute angle with respect to the electron beam axis, in a different direction than was shown in FIGS. 3-4, in accordance with an embodiment of the present invention.
Figure 6:
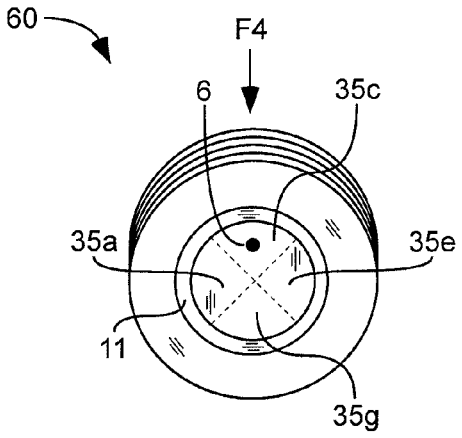
FIG. 6 is a schematic top view of a transmission x-ray tube including an end window tilted at an acute angle with respect to the electron beam axis, in a different direction than was shown in FIGS. 3-5, in accordance with an embodiment of the present invention.

The window 5 can include more than two different regions 35, such as four regions for example as shown in FIGS. 5 & 6. In addition to the directions of tilting the window shown in FIGS. 1-4, the window 5 can be tilted in a third direction (tilted up as shown in FIG. 5) at an acute angle by a force F3. The flexible coupling 4 can allow the window 5 to tilt at this acute angle. Tilting the window 5 at this acute angle can allow cause the electron beam axis 6 to pass through another region 35*g* of the window 5 (region 35*g* is shown as a bottom portion of the window 5 in the figures). The window 5 can be tilted in a fourth direction (tilted down in FIG. 6) at an acute angle by a force F4. The flexible coupling 4 can allow the window 5 to tilt at this acute angle. Tilting the window 5 at this acute angle can allow cause the electron beam axis 6 to pass through another region 35*c* of the window 5 (region 35*c* is shown as a top portion of the window 5 in the figures).

Decisions regarding the number of regions the electron beam axis 6 is allowed to pass through, and thus the number of regions the electron beam 12 will impinge upon, may be decided based on the mechanism used for applying force to tilt the window 5 and thus a number of different directions the window can be tilted towards, and also decided based on the number of different regions needed, or the number that may practically be used depending on the size of the window 5 and the size of the electron beam 12.

Although not shown in the figures, there may be multiple different regions in a single direction of tilt by using multiple angles of tilt in that direction. Each angle of tilt can be associated with a different region.

In one embodiment, the window 5 can be homogeneous throughout in terms of window thickness and target material. Thus, one region 35 can be identical to another region 35, and selection of different regions 35 can be done to allow the electron beam 12 to impinge on an unused region 35 of the target when an old region 35 is worn out.

In another embodiment, at least one region 35 can have a different thickness than at least one other region 35, or each region 35 can have a unique thickness. This embodiment may be used to allow the x-ray tube to be operated optimally at multiple voltages (DC voltage between the anode 11 and the cathode 2). Thus, relatively thinner region(s) may be used for lower tube voltages and relatively thicker region(s) may be used for higher tube voltages.

In another embodiment, at least one region 35 can have a different target material than at least one other region 35, or each region 35 can have a unique target material. Each different target material can be configured to change a characteristic of the x-rays emitted therefrom. Thus, one region 35 may include a silver target material and another region 35 may include a gold target material for example. X-ray spectra emitted from the silver target material can be different from x-ray spectra emitted from the gold target material, thus allowing the user to utilize either spectra without changing a direction of the x-rays emitted, and thus without a need to refocus the x-ray tube.

Figure 7:
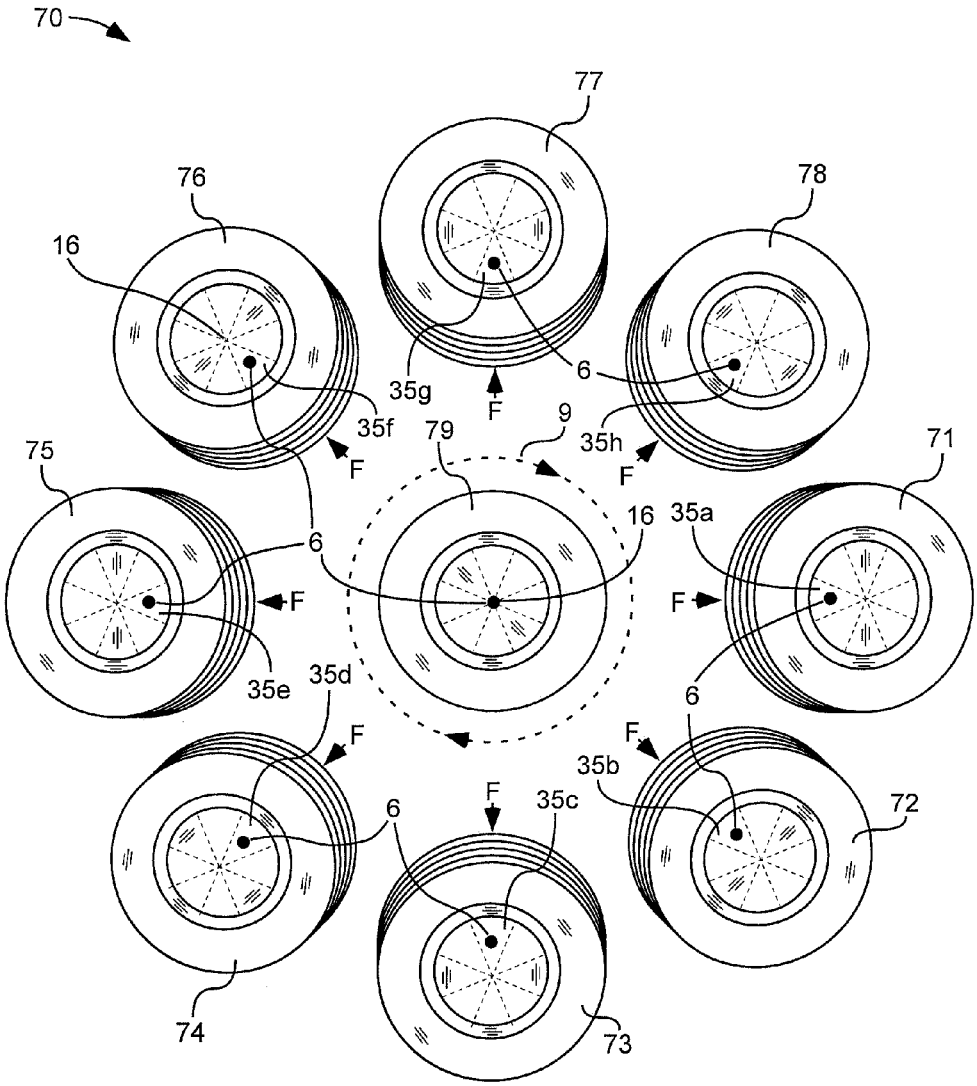
FIG. 7 is a schematic cross-sectional side view of a transmission x-ray tube including an end window tilted at an acute angle with respect to an electron beam axis and the acute angle of the window orbits around the electron beam axis by flexing the flexible coupling in different directions, in accordance with an embodiment of the present invention.

In one embodiment, as shown on x-ray source 70 in FIG. 7, a force F may be applied to the flexible coupling 4 in any direction in a 360 degree arc 9 around the electron beam axis 6. The 360 degree arc 9 can be in a plane that is perpendicular to the electron beam axis 6. The force F on the flexible coupling 4 can cause the flexible coupling to tilt, and thus can allow the window 5 to tilt at the acute angle A2 and/or A4 in any direction in the 360 degree arc 9 around the electron beam axis 6, to allow the acute angle A2 or A4 of the window 5 to orbit around the electron beam axis 6. The orbital motion of the window 5 can cause exposure of different regions 35 of the window 5 to the electron beam 12. This orbital motion can be defined as a nutating motion. Thus, the window can nutate.

For example, as shown in FIG. 7, the force F applied in a right direction can cause the window 5 of x-ray source 71 to tilt right and place the electron beam 6 in a left region 35*a*. The force F applied in a lower right direction can cause the window 5 of x-ray source 72 to tilt lower right and place the electron beam 6 in an upper left region 35*b*. The force F applied in a lower direction can cause the window 5 of x-ray source 73 to tilt down and place the electron beam 6 in an upper region 35*c*. The force F applied in a lower left direction can cause the window 5 of x-ray source 74 to tilt lower left and place the electron beam 6 in an upper right region 35*d*. The force F applied in a left direction can cause the window 5 of x-ray source 75 to tilt left and place the electron beam 6 in a right region 35*e*. The force F applied in an upper left direction can cause the window 5 of x-ray source 76 to tilt upper left and place the electron beam 6 in a lower right region 35*f*. The force F applied in an upper direction can cause the window 5 of x-ray source 77 to tilt up and place the electron beam 6 in a lower region 35*g*. The force F applied in an upper right direction can cause the window 5 of x-ray source 78 to tilt upper right and place the electron beam 6 in a lower left region 35*h*. No force F applied to x-ray source 79 can allow the window 5 to not tilt in any direction and can place the electron beam 6 in a central region 16. All directions as described above and as shown on FIG. 7 are based on application of the force F to the x-ray sources 71-79 positioned as shown from a top view.

Shown in FIG. 7 are eight regions 35. There may be more or less regions 35 than eight. If the force F can be applied in any direction, there can theoretically be many more than eight different positions, and thus many more than eight different regions 35. Practically, however, the number of regions 35 will be limited, based on window 5 size and electron beam 12 size.

Note that the motion shown in FIGS. 3-7 is a tilting of the flexible coupling 4 in different directions, rather than a twisting or rotational motion. Thus, the second end 4*b* of the flexible coupling 4 can be fixed to, or can remain fixed in position with respect to, the evacuated enclosure 1 such that the flexible coupling 4 will not rotate with respect to the evacuated enclosure 1. The window 5 can also be fixed to the first end 4*a* of the flexible coupling 4 such that the window 5 will not rotate with respect to the flexible coupling 4.

Another way of describing the motion of the flexible coupling 4 and the window 5, as shown in FIGS. 1-7, is by describing an orbital motion of a window axis 7 normal to an exterior face of the window 5. The window axis 7 is shown in FIG. 1 with an acute angle A1 between the window axis 7 and the electron beam axis 6. The window axis 7 is shown in FIG. 2 with an acute angle A3 between the window axis 7 and the electron beam axis 6. Thus, as shown in FIGS. 1-7, the window 5 and the first end 4*a* of the flexible coupling 4 can be movable about the electron beam axis 6 with the window axis 7 orbiting about the electron beam axis 6. This orbital motion can be with a fixed acute angle, such that A1 equals A3 (same numerical value but different direction), or the acute angle can differ (different numerical value of the angle) in the orbit. Generally, use of the same force F in every direction can result in orbiting with the same acute angle (A1=A3). The use of a different force F in different directions can result in orbiting with a different acute angle in some positions than in other positions (e.g. A1≠A3).

The window 5 can be attached such that with no force F applied, the electron beam axis 6 will pass through a central region 16 of the window 5 (e.g. x-ray source 79 in FIG. 70). The window can then be positioned by a force F with the electron beam axis 6 passing through a non-central region 35*a-h* of the window 5. The window 5 can then be tilted at an acute angle A2 or A4 in another direction to cause the electron beam axis 6 to pass through a different non-central region 35*a-h* of the window.

Figure 8:
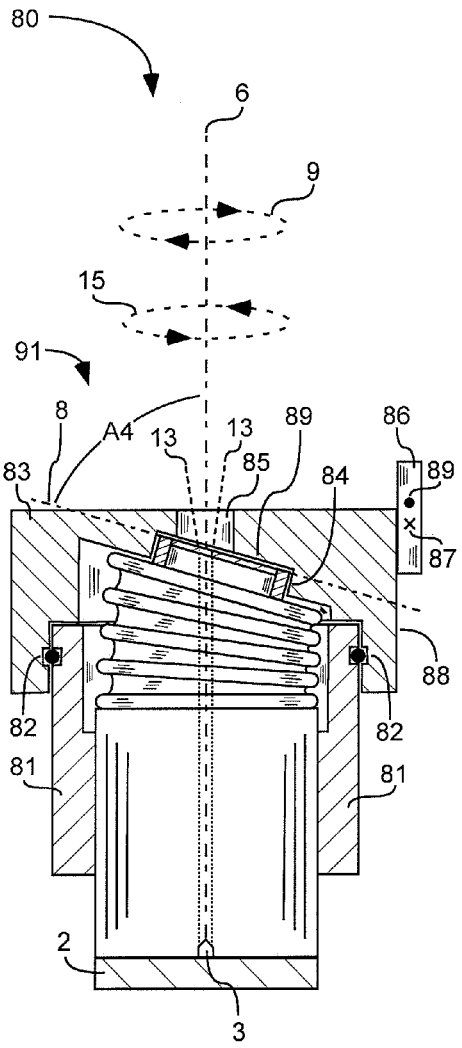
FIG. 8 is a schematic cross-sectional side view of a transmission x-ray tube including an end window tilted at an acute angle with respect to an electron beam axis, a ring rotatably coupled around the window, the ring including a cavity, the cavity sized and shaped to receive and engage the window, the cavity being offset with respect to the electron beam axis, the cavity causing the window to tilt at the acute angle, and rotation of the ring causing the window to tilt in different directions to allow the acute angle of the window to orbit around the electron beam axis, in accordance with an embodiment of the present invention.
Figure 9:
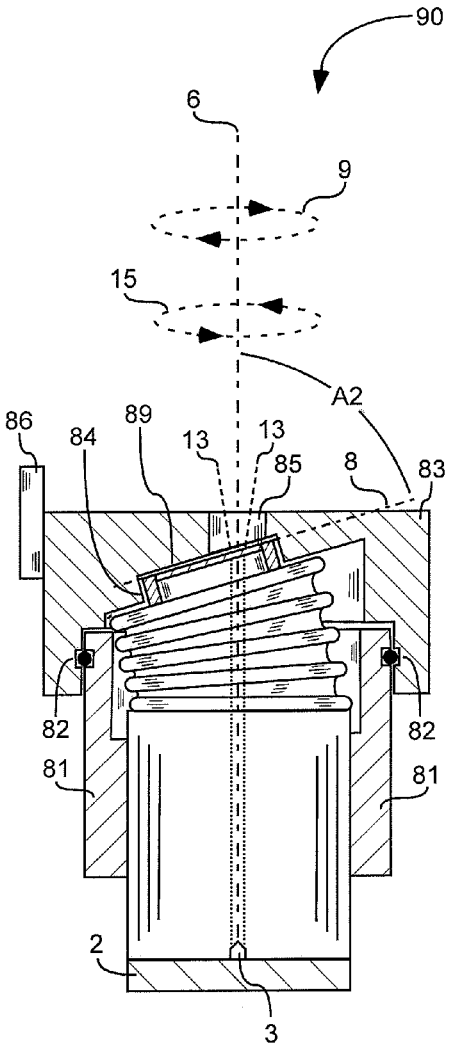
FIG. 9 is a schematic cross-sectional side view of a transmission x-ray tube similar to that shown in FIG. 8, except that the window is tilted at an acute angle in a different direction, in accordance with an embodiment of the present invention.

Shown in FIGS. 8-9 is one structure or means for providing an orbital rotation of the tilted window 5 at an acute angle A2 or A4. A ring 83 can be rotatably coupled around the window 5. The ring 83 can include a cavity 84. The cavity 84 can be sized and shaped to receive and engage the window 5. The cavity 84 can surround an outer perimeter of the window 5.

The cavity 84 can be offset with respect to the electron beam axis 6. The cavity 84 can be eccentric with respect to the electron beam axis 6 and/or ring 83. The cavity 84 can cause the window 5 to tilt at an acute angle A2 or A4. Rotation of the ring 83 can cause the window 5 to tilt in different directions to allow the acute angle A2 or A4 of the window 5 to orbit around the electron beam axis 6. The cavity 84 can include a hole 85 to allow x-rays 13 to pass through the hole 85 of the cavity 84 outwards from the x-ray source 80 and 90.

A ring support 81 can be attached to the x-ray tube enclosure 1. The ring 83 can rotate around the ring support 81. The ring support 81 can include a channel and the ring 83 can include a mating channel. A fastening device 82 can be used to attach the ring 83 to the ring support, and allow the ring 83 to rotate around the ring support 81. Examples of possible fastening devices 82 include a snap ring, ball bearings, or an e clip. Lubricant in the channels can minimize friction as the ring 83 rotates around the ring support 81.

In one embodiment, the cavity 84 can include a slanted face 89 facing a portion of the window 5. The slanted face 89 can be tilted at an acute angle A2 or A4 with respect to the electron beam axis 6. The slanted face 89 can cause the window 5 to tilt at the acute angle A2 or A4. Use of this design can cause the window 5 to tilt at a single acute angle A2 or A4 as this acute angle of the window 5 orbits in a 360 degree arc 9 around the electron beam axis 6.

The ring 83 can include a device 86, such as a handle on the ring 83 configured to allow an operator to rotate the ring 83 to different positions, or an electromechanical mechanism configured to rotate the ring 83 to different positions based on input from an operator. The ring 83 can have gears that intermesh with a gear drive mechanism for rotating the ring. A force on the device 86 out 89 of the page, tangential to a side 88 of the ring 83, can cause the ring 83 to rotate clockwise with respect to a top face 91 of x-ray source 80. Continued force on the device 86 tangential to a side 88 of the ring can cause the acute angle A2 or A4 to orbit around the electron beam axis 6 to a different position, such as for example to the position shown on x-ray source 90 in FIG. 9. Thus, as the ring 83 rotates, the acute angle A2 or A4 can orbit in a 360 degree arc 9 (clockwise with respect to a top face 91 of x-ray source 80) around the electron beam axis 6.

A force on the device 86 into 87 the page, tangential to a side 88 of the ring 83, can cause the ring 83 to rotate counter-clockwise with respect to a top face 91 of x-ray source 80. Continued force tangential to a side 88 of the ring 83 can cause the acute angle A2 or A4 to orbit around the electron beam axis 6 to a different position, such as for example to the position shown on x-ray source 90 in FIG. 9. Thus, as the ring 83 rotates, the acute angle A2 or A4 can orbit in a 360 degree arc 15 (counter-clockwise with respect to a top face 91 of x-ray source 80) around the electron beam axis 6.

Use of the ring 83 can have an advantage of allowing the window 5 acute angle A2 or A4 to orbit to any region 35 in a 360 degree arc 9 or 15 around the electron beam axis 6. Use of the ring can keep the window tilted at a single angle A2 or A4 regardless of the direction of tilt. Thus, the window 5 can maintain substantially the same angle A2 or A4 with respect to the electron beam axis 6 while the acute angle A2 or A4 orbits in a 360 degree arc 9 or 15 around the electron beam axis 6. The amount of tilt can be altered by the extent of eccentricity of the cavity 84 and/or by the angle of the slanted face 89.

The ring 83 can be a rotational means for applying force F to the window from any direction in a 360 degree arc 9 around and perpendicular with the electron beam axis 6. The force F from the rotational means can be capable of causing the window 5 to tilt at the acute angle A2 or A4 in any direction in the 360 degree arc 9 or 15.

Figure 10:
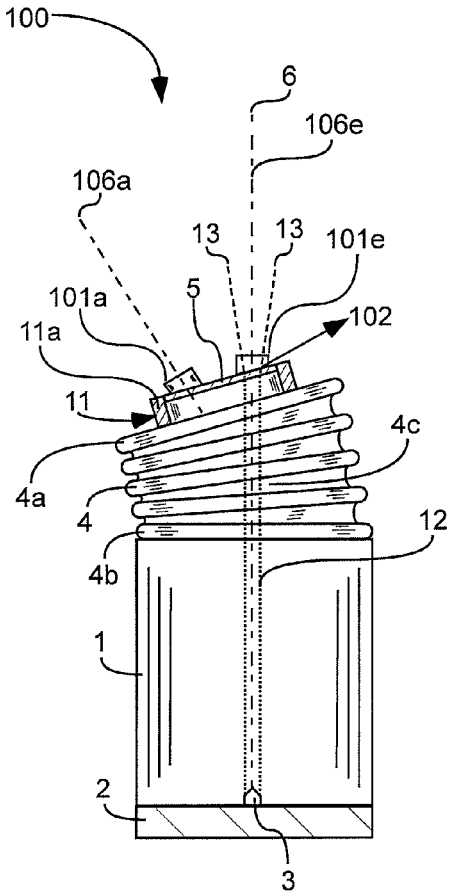
FIG. 10 is a schematic cross-sectional side view of a transmission x-ray tube including an end window tilted at an acute angle with respect to an electron beam axis, multiple collimators, each including a ring and a central aperture, attached to multiple regions on the window, each collimator aligned on the region to allow x-rays to pass through the aperture in a desired direction and to block x-rays from passing in undesired directions, in accordance with an embodiment of the present invention.
Figure 11:
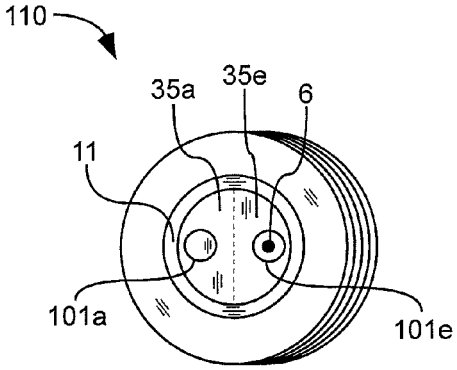
FIG. 11 is a schematic top view of a transmission x-ray tube including an end window tilted at an acute angle with respect to an electron beam axis, two collimators, each including a ring and a central aperture, each attached to a region on the window, each collimator aligned on the region to allow x-rays to pass through the aperture in a desired direction and to block x-rays from passing in undesired directions, in accordance with an embodiment of the present invention.
Figure 12:
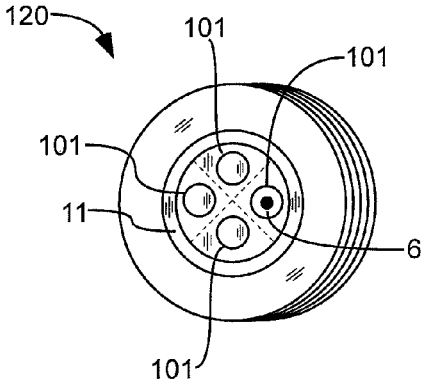
FIG. 12 is a schematic top view of a transmission x-ray tube including an end window tilted at an acute angle with respect to an electron beam axis, four collimators, each including a ring and a central aperture, each attached to a region on the window, each collimator aligned on the region to allow x-rays to pass through the aperture in a desired direction and to block x-rays from passing in undesired directions, in accordance with an embodiment of the present invention.

As shown in FIGS. 10-12, x-ray sources 100, 110, and 120 can include multiple collimators 101, each including an outer band or perimeter and a central aperture. One collimator can be attached to each region 35. Each collimator 101 can be aligned on the region 35 to allow x-rays 13 to pass through the aperture in a desired direction and to block x-rays 13 from passing in undesired directions 102.

Each of the multiple collimators 101 can be aligned on the region 35 such that a collimator axis (see for example **106*e* on collimator 101*e* attached to region 35*e*) through the aperture, parallel to a length of the collimator, will be substantially parallel with the electron beam axis 6 upon tilting the window 5 to allow x-rays 13 to pass through the region 35*a* and the aperture of the collimator 101**.

Each collimator 101 can be made of the same material, or can include a same material, as the target region 35 to which the collimator 101 is attached. This embodiment may be particularly useful if the different regions 35 have a different target material than other region(s).

Shown in FIG. 11 is x-ray source 110 with two regions **35*a* and 35*e*. One collimator 101*e* can be attached to one region 35*e* and a different collimator 101*a* can be attached to a different region 35*a*. The window 5 can be tilted to align the electron beam axis 6 with one region 35*e*, and the collimator axis 106*e* can be aligned with the electron beam axis 6. If the window 5 is tilted to align the electron beam axis 6 with a different region 35*a*, then the collimator axis 106*a* (see FIG. 10) of the collimator 101*a* on this region 35*a* can then be aligned with the electron beam axis 6. If the two regions 35*a* and 35*e* are made of different materials, the collimators 106*a* and 106*e* can also be made of different materials. Collimator 106*a* can be made of the same material, or can include a same material, as region 35*a*; and collimator 106*e* can be made of the same material, or can include a same material, as region 35*e*. Shown on x-ray source 120 in FIG. 12 is a window 5 with four regions 35 and a separate collimator 101** for each region.

For increased life of the x-ray source, the flexible coupling 4 can have a single direction of flexure or tilt at one time. Flexing the flexible coupling 4 in two directions at one time can result in added stress on the flexible coupling 4, which can reduce its life.

Figure 13:
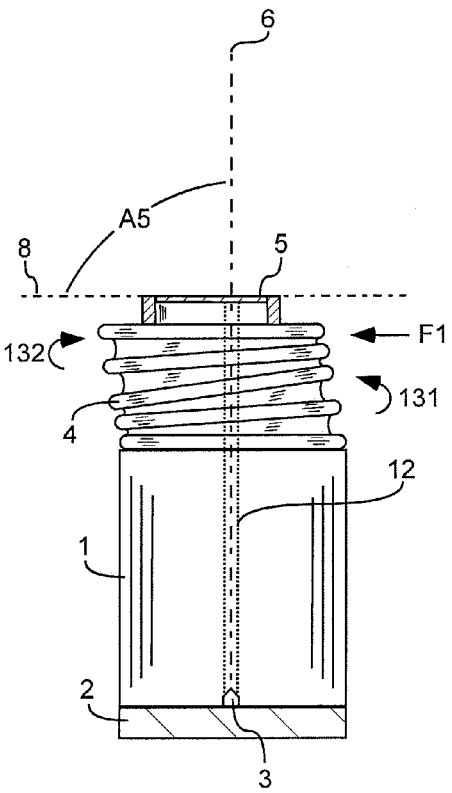
FIG. 13 is a schematic cross-sectional side view of a transmission x-ray tube with a flexible coupling that is flexed in two directions to keep the window perpendicular to the electron beam axis, in accordance with an embodiment of the present invention.

For example, shown in FIG. 13 is x-ray source 130 in which exposure of different regions 35 of the window 5 is accomplished by shifting or deflecting the window 5 side to side instead of tilting the window 5. Thus, on x-ray source 130, the angle of the window 5 with respect to the electron beam axis 6 can be 90°. This design can force the flexible coupling 4 to flex in two directions at one time (left or counterclockwise flexure 131 and right or clockwise flexure 132). This dual flexure can add extra stress to the flexible coupling 4, which can decrease its life. Thus, tilting the window 5 at an acute angle A2 or A4, as shown in FIGS. 1-12, rather than shifting or deflecting the window, can reduce stress on the flexible coupling and can result in longer life.

In some designs, however, it may be desirable to maintain a 90° angle of the window 5 with respect to the electron beam axis 6. Alternatively, manufacturing, allowed x-ray source space, and/or material cost considerations may make this design preferable. If a highly flexible coupling is used, then this design becomes more feasible.

Figure 14:
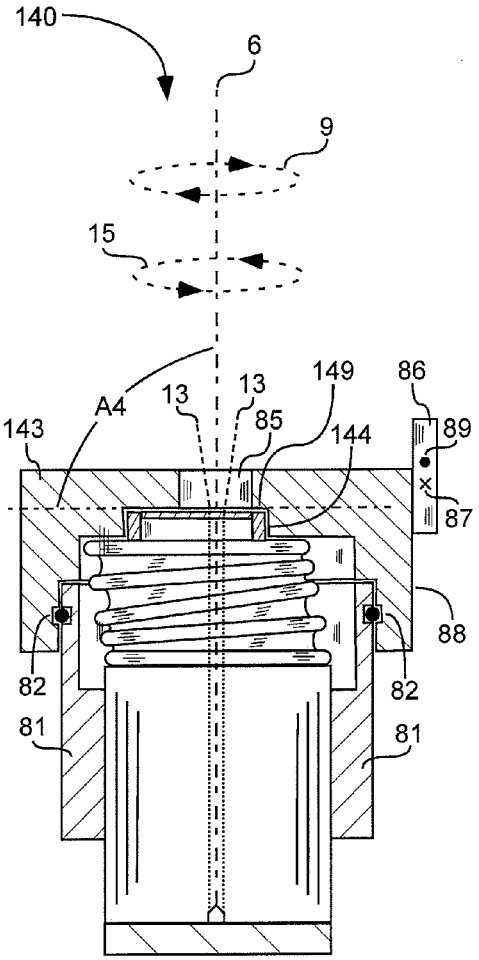
FIG. 14 is a schematic cross-sectional side view of a transmission x-ray tube including a flexible coupling that is flexed in two directions to keep the window perpendicular to the electron beam axis, a ring rotatably coupled around the window, the ring including a cavity, the cavity sized and shaped to receive and engage the window, and rotation of the ring causing the window to deflect in different directions to allow the electron beam to impinge on different regions of the window, in accordance with an embodiment of the present invention

As shown in FIG. 14, x-ray source 140 includes a ring 83 rotatably coupled around the window 5. The ring 143 includes a cavity 144. The cavity 144 can be sized and shaped to receive and engage the window 5. The cavity 144 can be eccentric with respect to the ring 143, and can be offset with respect to the electron beam axis 6. Rotation of the ring 143 can cause the window to deflect in different directions to allow the electron beam axis 6 to impinge on different regions 35 of the window 5.

In one embodiment, the cavity 144 can include a face 149 facing a portion of the window 5. The face 149 can be perpendicular to the electron beam axis 6. The face 149 can maintain the window 5 perpendicular to the electron beam axis as the ring 143 rotates.

X-ray sources 130 and 140 are similar to x-ray sources described above in reference to FIGS. 1-12, except that the angle of the window 5 with respect to the electron beam axis 6 can be 90° on x-ray sources 130 and 140. Therefore, all description of x-ray sources described above in reference to FIGS. 1-12 is incorporated by reference into the discussion of x-ray sources 130 and 140, except for the degree of angle between the window and the electron beam axis.

Method

A method of utilizing different regions of an x-ray tube target can comprise some or all of the following:

1. tilting a transmission x-ray tube end window 5 at an acute angle A2 or A4 with respect to an electron beam axis 6 extending between an electron emitter 3 and the window 5 to cause an electron beam 12 to impinge on a selected region 35 of the window 5;
2. tilting the window 5 in a different direction to selectively align a different selected region 35 of the window with the electron beam axis 6, and to cause the electron beam 12 to impinge on the different selected region of the window 5; and/or
3. selectively orbiting the acute angle A2 of the window 5 in a 360 degree arc 9 or 15 around the electron beam axis 6 to align multiple different selected regions 35 of the window 5 with the electron beam axis 6.

The structure of the x-ray tube in this method can be similar to the structure described above in reference to FIGS. 1-12, and thus the above description regarding FIGS. 1-12 is incorporated herein by reference.

What is claimed is:

1. A transmission x-ray tube comprising:

a. an end window hermetically sealed to a first end of a flexible coupling;

b. a second end of the flexible coupling hermetically sealed to one end of an enclosure;

c. a cathode including an electron emitter hermetically sealed to an opposite end of the enclosure;

d. the electron emitter configured to emit electrons in an electron beam along an electron beam axis extending between the electron emitter and the window and through a hollow core of the flexible coupling;

e. the window including a target material configured to produce x-rays in response to impinging electrons from the electron emitter;

f. the window configured to allow the x-rays to be transmitted out of the enclosure through the window; and g. the window being selectively tiltable to selectively align a region of the window with the electron beam axis, and thus selectively position the region in the electron beam by tilting the window and the first end of the flexible coupling at an acute angle with respect to the electron beam axis.

2. The transmission x-ray tube of claim 1, wherein the window includes at least two different regions, each region having a different thickness than at least one other region.

3. The transmission x-ray tube of claim 1, wherein the target material includes multiple different target materials, each region having a different target material than at least one other region, the different target materials configured to change a characteristic of the x-rays emitted therefrom.

4. The transmission x-ray tube of claim 1, wherein the window is positioned with the electron beam axis passing through a non-central region of the window, and tilting the window at the acute angle in another direction causes the electron beam axis to pass through a different non-central region of the window.

5. The transmission x-ray tube of claim 1, wherein:

a. the acute angle of the window orbits around the electron beam axis by flexing the flexible coupling in different directions;

b. the window remains tilted at the acute angle with respect to the electron beam axis; and c. the second end of the flexible coupling remains fixed in position with respect to the evacuated enclosure.

6. The transmission x-ray tube of claim 1, wherein the window and the first end of the flexible coupling are movable about the electron beam axis with a window axis normal to an exterior face of the window orbiting about the electron beam axis with a fixed acute angle.

7. The transmission x-ray tube of claim 1, further comprising:

a. a ring rotatably coupled around the window;

b. the ring including a cavity;

c. the cavity sized and shaped to receive and engage the window;

d. the cavity being offset with respect to the electron beam axis;

e. the cavity causing the window to tilt at the acute angle; and f. rotation of the ring causing the window to tilt in different directions to allow the acute angle of the window to orbit around the electron beam axis.

8. The transmission x-ray tube of claim 7, wherein:

a. the cavity includes a slanted face facing a portion of the window;

b. the slanted face is tilted at the acute angle with respect to the electron beam axis; and c. the slanted face causes the window to tilt at the acute angle.

9. The transmission x-ray tube of claim 7, wherein the window maintains substantially the same angle with respect to the electron beam axis while orbiting around the electron beam axis.

10. The transmission x-ray tube of claim 9, wherein the same angle of the window with respect to the electron beam axis is an angle between 70 degrees and 85 degrees.

11. The transmission x-ray tube of claim 1, further comprising:

a. multiple collimators, each including a ring and a central aperture;

b. one collimator is attached to each region; and c. each collimator is aligned on the region to allow x-rays to pass through the aperture in a desired direction and to block x-rays from passing in undesired directions.

12. The transmission x-ray tube of claim 11, wherein each of the multiple collimators is aligned on the region such that a collimator axis through the aperture, parallel to a length of the collimator, will be substantially parallel with the electron beam axis upon tilting the window to allow x-rays to pass through the region and the aperture of the collimator.

13. The transmission x-ray tube of claim 11, wherein:

a. at least one of the regions having a different target material than at least one other region, the different target materials configured to change a characteristic of the x-rays emitted therefrom; and b. each collimator is made of the same material as the target material of the region to which it is attached.

14. A transmission x-ray tube comprising:

a. an end window hermetically sealed to a first end of a flexible coupling;

b. a second end of the flexible coupling hermetically sealed to an enclosure;

c. a cathode including an electron emitter hermetically sealed to the enclosure;

d. the electron emitter configured to emit electrons in an electron beam along an electron beam axis extending through the enclosure, through a hollow core of the flexible coupling, and between the electron emitter and the window;

e. the window:

i. configured to produce x-rays in response to impinging electrons from the electron emitter and to emit the x-rays through the window, out of the enclosure;

ii. having at least two different regions;

iii. being selectively deflectable with respect to the electron beam axis to selectively align one of the regions with the electron beam axis, and thus selectively position one of the regions in the electron beam by deflecting the window;

d. a ring rotatably coupled around the window;

e. the ring including a cavity;

f. the cavity sized and shaped to receive and engage the window;

g. the cavity being eccentric with respect to the ring; and h. rotation of the ring causing the window to deflect in different directions to allow the electron beam axis to impinge on different regions of the window.

15. The transmission x-ray tube of claim 14, wherein:

a. the cavity includes a slanted face facing a portion of the window;

b. the slanted face tilted at an acute angle with respect to the electron beam axis; and c. the slanted face causing the window to tilt at the acute angle.

16. The transmission x-ray tube of claim 14, further comprising:

a. multiple collimators, each including a ring and a central aperture;

b. one collimator is attached to each region;

c. each collimator is aligned on the region to allow x-rays to pass through the aperture in a desired direction and to block x-rays from passing in undesired directions.

17. The transmission x-ray tube of claim 16, wherein:

a. the at least two different regions each have a different target material than at least one other region, the different target materials configured to change a characteristic of the x-rays emitted therefrom; and b. each collimator is made of the same material as the target material of the region to which it is attached.

18. The transmission x-ray tube of claim 14, wherein the flexible coupling includes a bellows.

19. A method of utilizing different regions of an x-ray tube target, the method comprising:

a. tilting a transmission x-ray tube end window at an acute angle with respect to an electron beam axis extending between an electron emitter and the window to cause an electron beam to impinge on a selected region of the window; and b. tilting the window in a different direction to selectively align a different selected region of the window with the electron beam axis, and to cause the electron beam to impinge on the different selected region of the window.

20. The method of claim 19, further comprising selectively orbiting the acute angle of the window in a 360 degree arc around the electron beam axis to align multiple different selected regions of the window with the electron beam axis.

* * * * *